US006596033B1

(12) United States Patent
Luo et al.

(10) Patent No.: US 6,596,033 B1
(45) Date of Patent: Jul. 22, 2003

(54) LYOCELL NONWOVEN FABRIC AND PROCESS FOR MAKING

(75) Inventors: Mengkui Luo, Federal Way, WA (US); Vincent A. Roscelli, Edgewood, WA (US); Amar N. Neogi, Seattle, WA (US); Richard A. Jewell, Bellevue, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/548,794

(22) Filed: Apr. 13, 2000

Related U.S. Application Data

(60) Division of application No. 09/039,737, filed on Mar. 16, 1998, now Pat. No. 6,235,392, which is a continuation-in-part of application No. 08/916,652, filed on Aug. 22, 1997, now abandoned.

(60) Provisional application No. 60/023,909, filed on Aug. 23, 1996, and provisional application No. 60/024,462, filed on Aug. 23, 1996.

(51) Int. Cl.[7] ..... D06M 0/00; D06Q 1/02

(52) U.S. Cl. ..... 8/115.15; 8/137; 264/196; 264/203; 428/224; 428/370; 428/373

(58) Field of Search ..... 428/224, 370, 428/373; 264/196, 203; 8/137, 115.15

(56) References Cited

U.S. PATENT DOCUMENTS

| | | | | | |
|---|---|---|---|---|---|
| 4,242,405 | A | * | 12/1980 | Backno | 428/224 |
| 4,245,000 | A | * | 1/1981 | Bockno | 428/224 |
| 4,246,221 | A | * | 1/1981 | McCorsley, III | 264/203 |
| 4,383,962 | A | * | 5/1983 | Isome et al. | 264/196 |
| 5,591,388 | A | | 1/1997 | Sellars et al. | |
| 5,601,765 | A | | 2/1997 | Sellars et al. | |
| 5,736,087 | A | * | 4/1998 | Rosenberg | 264/188 |
| 6,197,230 | B1 | | 3/2001 | Pierre et al. | |
| 6,358,461 | B1 | * | 3/2002 | Law et al. | 264/518 |

* cited by examiner

*Primary Examiner*—Yogendra N. Gupta
*Assistant Examiner*—Derrick Hamlin
(74) *Attorney, Agent, or Firm*—Christensen O'Connor Johnson Kindness PLLC

(57) ABSTRACT

The invention is lyocell fiber characterized by a pebbled surface as seen at high magnification and having a variable cross section and diameter along and between fibers. The fiber is produced by centrifugal spinning, melt blowing or its spunbonding variation. The fibers can be made in the microdenier range with average weights as low as one denier or less. The fibers have inherently low gloss and can be formed into tight yarns for making fabrics of very soft hand. Alternatively, the fibers can be formed into self bonded nonwoven fabrics.

10 Claims, 11 Drawing Sheets

Commercial Lyocell Fiber - 100X

Commercial Lyocell Fiber - 10,000X

Centrifugally Spun Fiber - 200X

Centrifugally Spun Fiber - 10,000X

Centrifugally Spun Fiber End - 2,000X

Centrifugally Spun Fiber End - 2,000X

Melt Blown Fiber - 100X

Melt Blown Fiber - 10,000X

Abraded Commercial Fiber 1 - 1000X

Abraded Commercial Fiber 2 - 1000X

Abraded Melt Blown Fiber 1 - 1000X

Abraded Melt Blown Fiber 2 - 1000X

LYOCELL NONWOVEN FABRIC AND PROCESS FOR MAKING

PRIORITY

This application is a divisional application of application Ser. No. 09/039,737, filed Mar. 16, 1998 U.S. Pat. No. 6,235,392, which in turn is a continuation-in-part of application Ser. No. 08/916,652, now abandoned filed Aug. 22, 1997, which claims priority from Provisional Application Serial Nos. 60/023,909 and 60/024,462, both filed Aug. 23, 1996.

FIELD OF THE INVENTION

The present invention is directed to lyocell fibers having novel characteristics and to the method for their preparation. It is also directed to yarns produced from the fibers, and to woven and nonwoven fabrics containing the fibers. In particular, the method involves first dissolving cellulose in an amine oxide to form a dope. Latent fibers are then produced either by extrusion of the dope through small apertures into an air stream which draws the latent filaments of cellulose solution or by centrifugally expelling the dope through small apertures. The fibers are then formed by regenerating the spun latent fibers in a liquid nonsolvent. Either process is amenable to the production of self bonded nonwoven fabrics.

BACKGROUND OF THE INVENTION

For over a century strong fibers of regenerated cellulose have been produced by the viscose and cuprammonium processes. The latter process was first patented in 1890 and the viscose process two years later. In the viscose process cellulose is first steeped in a mercerizing strength caustic soda solution to form an alkali cellulose. This is reacted with carbon disulfide to form cellulose xanthate which is then dissolved in dilute caustic soda solution. After filtration and deaeration, the xanthate solution is extruded from submerged spinnerets into a regenerating bath of sulfuric acid, sodium sulfate, zinc sulfate, and glucose to form continuous filaments. The resulting so-called viscose rayon is presently used in textiles and was formerly widely used as reinforcing in rubber articles such as tires and drive belts.

Cellulose is also soluble in a solution of ammoniacal copper oxide. This property formed the basis for production of cuprammonium rayon. The cellulose solution is forced through submerged spinnerets into a solution of 5% caustic soda or dilute sulfuric acid to form the fibers. After decoppering and washing the resulting fibers have great wet strength. Cuprammonium rayon is available in fibers of very low deniers and is used almost exclusively in textiles.

More recently other cellulose solvents have been explored. One such solvent is based on a solution of nitrogen tetroxide in dimethyl formamide. While much research was done, no commercial process has resulted for forming regenerated cellulose fibers using this solvent.

The usefulness of tertiary amine N-oxides as cellulose solvents has been known for a considerable time. Graenacher, in U.S. Pat. No. 2,179,181, discloses a group of amine oxide materials suitable as solvents. However, the inventor was only able to form solutions with low concentrations of cellulose and solvent recovery presented a major problem. Johnson, in U.S. Pat. No. 3,447,939, describes the use of anhydrous N-methylmorpholine-N-oxide (NMMO) and other amine N-oxides as solvents for cellulose and many other natural and synthetic polymers. Again the solutions were of relatively low solids content. In his later U.S. Pat. No. 3,508,941, Johnson proposed mixing in solution a wide variety of natural and synthetic polymers to form intimate blends with cellulose. A nonsolvent for cellulose such as dimethylsulfoxide was added to reduce dope viscosity. The polymer solution was spun directly into cold methanol but the resulting filaments were of relatively low strength.

However, beginning in 1979 a series of patents were issued to preparation of regenerated cellulose fibers using various amine oxides as solvents. In particular, N-methylmorpholine-N-oxide with about 12% water present proved to be a particularly useful solvent. The cellulose was dissolved in the solvent under heated conditions, usually in the range of 90° C. to 130° C., and extruded from a multiplicity of fine apertured spinnerets into air. The filaments of cellulose dope are continuously mechanically drawn in air by a factor in the range of about three to ten times to cause molecular orientation. They are then led into a nonsolvent, usually water, to regenerate the cellulose. Other regeneration solvents, such as lower aliphatic alcohols, have also been suggested. Examples of the process are detailed in McCorsley and McCorsley et al. U.S. Pat. Nos. 4,142,913; 4,144,080; 4,211,574; 4,246,221, and 4,416,698 and others. Jurkovic et al., in U.S. Pat. No. 5,252,284 and Michels et al., in U.S. Pat. No. 5,417,909 deal especially with the geometry of extrusion nozzles for spinning cellulose dissolved in NMMO. Brandner et al., in U.S. Pat. No. 4,426,228, is exemplary of a considerable number of patents that disclose the use of various compounds to act as stabilizers in order to prevent cellulose and/or solvent degradation in the heated NMMO solution. Franks et al., in U.S. Pat. Nos. 4,145,532 and 4,196,282, deal with the difficulties of dissolving cellulose in amine oxide solvents and of achieving higher concentrations of cellulose.

Cellulose textile fibers spun from NMMO solution are referred to as lyocell fibers. Lyocell is an accepted generic term for a fiber composed of cellulose precipitated from an organic solution in which no substitution of hydroxyl groups takes place and no chemical intermediates are formed. One lyocell product produced by Courtaulds, Ltd. is presently commercially available as Tencel® fiber. These fibers are available in 0.9–2.7 denier weights and heavier. Denier is the weight in grams of 9000 meters of a fiber. Because of their fineness, yarns made from them produce fabrics having extremely pleasing hands.

One limitation of the lyocell fibers made presently is a function of their geometry. They are continuously formed and typically have quite uniform, generally circular or oval cross sections, lack crimp as spun, and have relatively smooth, glossy surfaces. This makes them less than ideal as staple fibers since it is difficult to achieve uniform separation in the carding process and can result in non-uniform blending and uneven yam. In part to correct the problem of straight fibers, man made staple fibers are almost always crimped in a secondary process prior to being chopped to length. Examples of crimping can be seen in U.S. Pat. Nos. 5,591,388 or 5,601,765 to Sellars et al. where the fiber tow is compressed in a stuffer box and heated with dry steam. It might also be noted that fibers having a continuously uniform cross section and glossy surface produce yams tending to have a "plastic" appearance. Yarns made from thermoplastic polymers frequently must have delustering agents, such as titanium dioxide, added prior to spinning. Wilkes et al., in U.S. Pat. No. 5,458,835, teach the manufacture of viscose rayon fibers having cruciform and other cross sections. U.S. Pat. No. 5,417,909 to Michels et al. discloses the use of profiled spinnerets to produce lyocell fibers having non-circular cross sections but the present inventors are not aware of any commercial use of this method.

Two widely recognized problems of lyocell fabrics are caused by fibrillation of the fibers under conditions of wet abrasion, such as might result during laundering. Fibrillation tends to cause "pilling"; i.e., entanglement of fibrils into small relatively dense balls. It is also responsible for a "frosted" appearance in dyed fabrics. Fibrillation is believed to be caused by the high orientation and apparent poor lateral cohesion within the fibers. There is an extensive technical and patent literature discussing the problem and proposed solutions. As examples, reference might be made to papers by Mortimer, S. A. and A. A. Péguy, *Journal of Applied Polymer Science,* 60:305–316 (1996) and Nicholai M., A. Nechwatal, and K. P. Mieck, *Textile Research Journal,* 66(9):575–580 (1996). The first authors attempt to deal with the problem by modifying the temperature, relative humidity, gap length, and residence time in the air gap zone between extrusion and dissolution. Nicholai et al. suggest crosslinking the fiber but note that " . . . at the moment, technical implementation [of the various proposals] does not seem to be likely". A sampling of related United States Patents might include those to Taylor, U.S. Pat. Nos. 5,403,530, 5,520,869, 5,580,354, and 5,580,356; Urben, U.S. Pat. No. 5,562,739; and Weigel et al. U.S. Pat. No. 5,618,483. These patents mostly relate to treatment of the fibers with reactive materials to induce surface modification or crosslinking. Enzymatic treatment of yams or fabrics is currently the preferred way of reducing problems caused by fibrillation. However, all of the treatments noted have disadvantages and increase the cost. A fiber that was resistant to fibrillation would be a significant advantage.

Kaneko et al. in U.S. Pat. No. 3,833,438 teach preparation of self bonded cellulose nonwoven materials made by the cuprammonium rayon process. Self bonded lyocell nonwoven webs have not been described to the best of the present inventors' knowledge.

Low denier fibers from synthetic polymers have been produced by a number of extrusion processes. Three of these are relevant to the present invention. One is generally termed "melt blowing". The molten polymers are extruded through a series of small diameter orifices into an air stream flowing generally parallel to the extruded fibers. This draws or stretches the fibers as they cool. The stretching serves two purposes. It causes some degree of longitudinal molecular orientation and reduces the ultimate fiber diameter. A somewhat similar process is called "spunbonding" where the fiber is extruded into a tube and stretched by an air flow through the tube caused by a vacuum at the distal end. In general, spunbonded fibers are continuous while melt blown fibers are more usually in discrete shorter lengths. The other process, termed "centrifugal spinning", differs in that the molten polymer is expelled from apertures in the sidewalls; of a rapidly spinning drum. The fibers are drawn somewhat by air resistance as the drum rotates. However, there is not usually a strong air stream present as in meltblowing. All three processes may be used to make nonwoven fabric materials. There is an extensive patent and general technical literature on the processes since they have been commercially important for many years. Exemplary patents to meltblowing are Weber et al., U.S. Pat. No. 3,959,421, and Milligan et al., U.S. Pat. No. 5,075,068. The Weber et al. patent uses a water spray in the gas stream to rapidly cool the fibers. A somewhat related process is described in PCT Publication WO 91/18682 which is directed to a method for coating paper by modified meltblowing. Coating materials suggested are aqueous liquids such as "an aqueous solution of starch, carboxy-methylcellulose, polyvinyl alcohol, latex, a suspension of bacterial cellulose, or any aqueous material, solution or emulsion". However, this process actually atomizes the extruded material rather than forms it into latent fibers. Zikeli et al., in U.S. Pat. Nos. 5,589,125 and 5,607,639, direct a stream of air transversely across strands of extruded lyocell dope as they leave the spinnerets. This air stream serves only to cool and does not act to stretch the filaments.

Centrifugal spinning is exemplified in U.S. Pat. Nos. 5,242,633 and 5,326,241 to Rook et al. Okada et al., in U.S. Pat. No. 4,440,700 describe a centrifugal spinning process for thermoplastic materials. As the material is ejected the fibers are caught on an annular form surrounding the spinning head and moved downward by a curtain of flowing cooling liquid. Included among the list of polymers suited to the process are polyvinyl alcohol and polyacrylonitrile. In the case of these two materials they are spun "wet"; i.e., in solution, and a "coagulation bath" is substituted for the curtain of cooling liquid.

With the exception of the Kaneko et al. patent noted above, processes analogous to melt blowing, spunbonding and centrifugal spinning have never been used with cellulosic materials since cellulose itself is basically infusible.

Extremely fine fibers, termed "microdenier fibers" generally are regarded as those having a denier of 1.0 or less. Meltblown fibers produced from various synthetic polymers, such as polypropylene, nylons, or polyesters are available with diameters as low as 0.4 $\mu$m (approximately 0.001 denier). However, the strength or "tenacity" of most of these fibers tends to be low and their generally poor water absorbency is a negative factor when they are used in fabrics for clothing. Microdenier cellulose fibers, as low as 0.5 denier, have been produced before the present only by the viscose process.

The present process produces a new lyocell fiber that overcomes many of the limitations of the fibers produced from synthetic polymers, rayons, and the presently available lyocell fibers. It allows formation of fibers of low denier and with a distribution of deniers. At the same time, the surface of each fiber tends to be pebbled, as seen at high magnification, and the fibers have a cross section of varying shape and diameter along their length, have significant natural crimp, and are resistant to fibrillation under conditions of wet abrasion. All of these are desirable characteristics that are found in most natural fibers but are missing in lyocell fibers produced commercially to the present.

SUMMARY OF THE INVENTION

In one embodiment of the invention, a method of forming a lyocell nonwoven fabric is disclosed. The method includes depositing a multiplicity of strands of a cellulose solution from the spinning apertures onto a receiving surface to form a fiber mat, contacting the formed mat with a regenerating solution, and removing the regenerated mat from the receiving surface. In one embodiment, the receiving surface can be a moving receiving surface.

In another embodiment of a method for forming a lyocell nonwoven fabric, the method includes stretching cellulose solution into filaments using a gas.

The present invention is directed to a process for production of regenerated cellulose fibers and webs and to the fibers and webs so produced. The terms "cellulose" and "regenerated cellulose" as used here should be construed sufficiently broadly to encompass blends of cellulose with other natural and synthetic polymers, mutually soluble in a spinning solvent, in which cellulose is the principal component by weight. In particular it is directed to low denier fibers produced from cellulose solutions in amine N-oxides by processes analogous to melt blowing or centrifugal spinning. Where the terms "melt blowing", "spunbonding", and "centrifugal spinning" are used it will be understood that these refer to processes that are similar or analogous to the processes used for production of thermoplastic fibers, even though the cellulose is in solution and the spinning temperature is only moderately elevated. The term "continuously drawn" refers to the present commercial process for manufacture of lyocell fibers where they are mechanically pulled, first through an air gap to cause elongation and molecular orientation then through the regeneration bath.

The processes involve dissolving a cellulosic raw material in an amine oxide, preferably N-methylmorpholine-N-oxide (NMMO) with some water present. This dope, or cellulose solution in NMMO, can be made by known technology; e.g., as is discussed in any of the McCorsley or Franks et al. patents aforenoted. In the present process, the dope is then transferred at somewhat elevated temperature to the spinning apparatus by a pump or extruder at about 90° C. to 130° C. Ultimately the dope is directed through a multiplicity of small orifices into air. In the case of melt blowing, the extruded threads of cellulose dope are picked up by a turbulent gas stream flowing in a generally parallel direction to the path of the filaments. As the cellulose solution is ejected through the orifices the liquid strands or latent filaments are drawn (or significantly decreased in diameter and increased in length) during their continued trajectory after leaving the orifices. The turbulence induces a natural crimp and some variability in ultimate fiber diameter both between fibers and along the length of individual fibers. This is in marked contrast to continuously drawn fibers where diameters are uniform and crimp is lacking or must be introduced as a post spinning process. The crimp is irregular and will have a peak to peak amplitude greater than about one fiber diameter and a period greater than about five fiber diameters.

Spunbonding can be regarded as a species of meltblowing in that the fibers are picked up and drawn in an airstream without being mechanically pulled. In the context of the present invention meltblowing and spunbonding should be regarded as functional equivalents.

Where the fibers are produced by centrifugal spinning, the dope strands are expelled through small orifices into air and are drawn by the inertia imparted by the spinning head. The filaments are then directed into a regenerating solution or a regenerating solution is sprayed onto the filaments. Regenerating solutions are nonsolvents such as water, lower aliphatic alcohols, or mixtures of these. The NMMO used as the solvent can then be recovered from the regenerating bath for reuse.

Turbulence and oscillation in the air around the latent fiber strands is believed to be responsible for their unique geometry when made either by the melt blowing or centrifugal spinning process.

Filaments having an average size as low as 0.1 denier or even less can be readily formed. Denier can be controlled by a number of factors including but not limited to orifice diameter, gas stream speed, spinning head speed, and dope viscosity. Dope viscosity is, in turn, largely a factor of cellulose D.P. and concentration. Fiber length can be similarly controlled by design and velocity of the air stream surrounding the extrusion orifices. Continuous fibers or relatively short staple fibers can be produced depending on spinning conditions. Equipment can be readily modified to form individual fibers or to lay them into a mat of nonwoven cellulosic fabric. In the latter case the mat may be formed and become self bonded prior to regeneration of the cellulose. The fibers are then recovered from the regenerating medium, further washed, bleached if necessary, dried, and handled conventionally from that point in the process.

Gloss or luster of the fibers is considerably lower than continuously drawn lyocell fiber lacking a delusterant so they do not have a "plastic" appearance. This is believed to be due to their unique "pebbled" surface apparent in high magnification micrographs.

By properly controlling spinning conditions the fibers can be formed with variable cross sectional shape and a relatively narrow distribution of fiber diameters. Some variation in diameter and cross sectional configuration will typically occur along the length of individual fibers and between fibers. The fibers are unique for regenerated cellulose and similar in morphology to many natural fibers.

Fibers produced by either the melt blowing or centrifugal spinning processes possess a natural crimp quite unlike that imparted by a stuffer box. Crimp imparted by a stuffer box is relatively regular, has a relatively low amplitude usually less than one fiber diameter, and short peak-to-peak period normally not more than two or three fiber diameters. That of the present fibers has an irregular amplitude greater than one fiber diameter, usually much greater, and an irregular period exceeding about five fiber diameters, a characteristic of fibers having a curly or wavy appearance.

Quite unexpectedly, the fibers of the present invention appear to be highly resistant to fibrillation under conditions of wet abrasion. This is a major advantage in that no post spinning processing is required, such as crosslinking or enzymatic treatment.

Properties of the fibers of the present invention are well matched for carding and spinning in conventional textile manufacturing processes. The fibers, while having many of the attributes of natural fibers, can be produced in microdenier diameters unavailable in nature. It is possible to directly produce self bonded webs or tightly wound multi-ply yams.

A particular advantage of the present invention is the ability to form blends of cellulose with what might otherwise be considered as incompatible polymeric materials. The amine oxides are extremely powerful solvents and can dissolve many other polymers beside cellulose. It is thus possible to form blends of cellulose with materials such as lignin, nylons, polyethylene oxides, polypropylene oxides, poly(acrylonitrile), poly(vinylpyrrolidone), poly(acrylic acid), starches, poly(vinyl alcohol), polyesters, polyketones, casein, cellulose acetate, amylose, amylopectins, cationic starches, and many others. Each of these materials in homogeneous blends with cellulose can produce fibers having new and unique properties.

It is an object of the present invention to provide a method of forming low denier regenerated cellulose fibers or cellulose blend fibers from solution in an amine oxide-water medium by processes analogous to melt blowing, spunbonding, or centrifugal spinning.

It is a further object to provide low denier cellulose fibers having advantageous geometry and surface characteristics for forming into yarns.

It is still another object to provide fibers having natural crimp and low luster.

It is an additional object to provide a lyocell fiber resistant to fibrillation under conditions of wet abrasion.

It is also an object to provide regenerated cellulose fibers having many properties similar or superior to natural fibers.

It is yet another object to provide a method of forming fibers of the above types by a process in which all production chemicals can be readily recovered and reused.

It is another object to provide self bonded nonwoven lyocell fabrics.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The type of cellulosic raw material used with the present invention is not critical. It may be bleached or unbleached wood pulp which can be made by various processes of which kraft, prehydrolyzed kraft, or sulfite would be exemplary. Many other cellulosic raw materials, such as purified cotton linters, are equally suitable. Prior to dissolving in the amine oxide solvent the cellulose, if sheeted, is normally shredded into a fine fluff to promote ready solution.

The solution of the cellulose can be made in a known manner; e.g., as taught in McCorsley U.S. Pat. No. 4,246,221. Here the cellulose is wet in a non-solvent mixture of about 40% NMMO and 60% water. The ratio of cellulose to wet NMMO is about 1:5.1 by weight. The mixture is mixed in a double arm sigma blade mixer for about 1.3 hours under vacuum at about 120° C. until sufficient water has been distilled off to leave about 12–14% based on NMMO so that a cellulose solution is formed. The resulting dope contains approximately 30% cellulose. Alternatively, NMMO of appropriate water content may be used initially to obviate the need for the vacuum distillation. This is a convenient way to prepare spinning dopes in the laboratory where commercially available NMMO of about 40–60% concentration can be mixed with laboratory reagent NMMO having only about 3% water to produce a cellulose solvent having 7–15% water. Moisture normally present in the cellulose should be accounted for in adjusting necessary water present in the solvent. Reference might be made to articles by Chanzy, H. and A. Péguy, *Journal of Polymer Science, Polymer Physics Ed.,* 18:1137–1144 (1980) and Navard, P. and J. M. Haudin *British Polymer Journal,* p 174, December 1980 for laboratory preparation of cellulose dopes in NMMO-water solvents.

Figure 1:
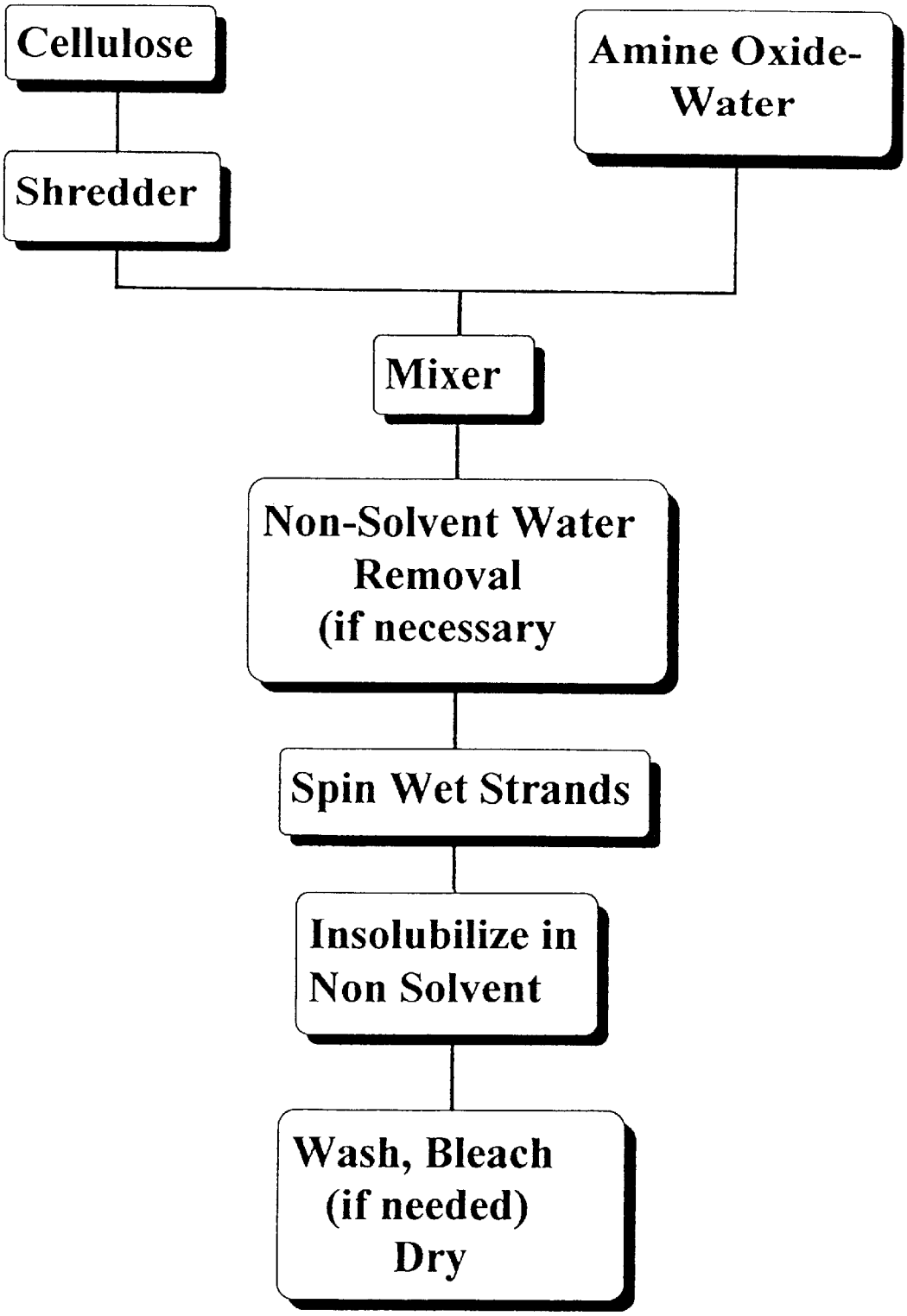
FIG. 1 is a block diagram of the steps used in practice of the present process.

Reference to FIG. 1 will show a block diagram of the present process. As was noted, preparation of the cellulose dopes in aqueous NMMO is conventional. What is not conventional is the way these dopes are spun. The cellulose solution is forced from extrusion orifices into a turbulent air stream rather than directly into a regeneration bath as is the case with viscose or cuprammonium rayon. Only later are the latent filaments regenerated. However, the present process also differs from the conventional processes for forming lyocell fibers since the dope is not continuously drawn linearly downward as unbroken threads through an air gap and into the regenerating bath.

Figure 2:
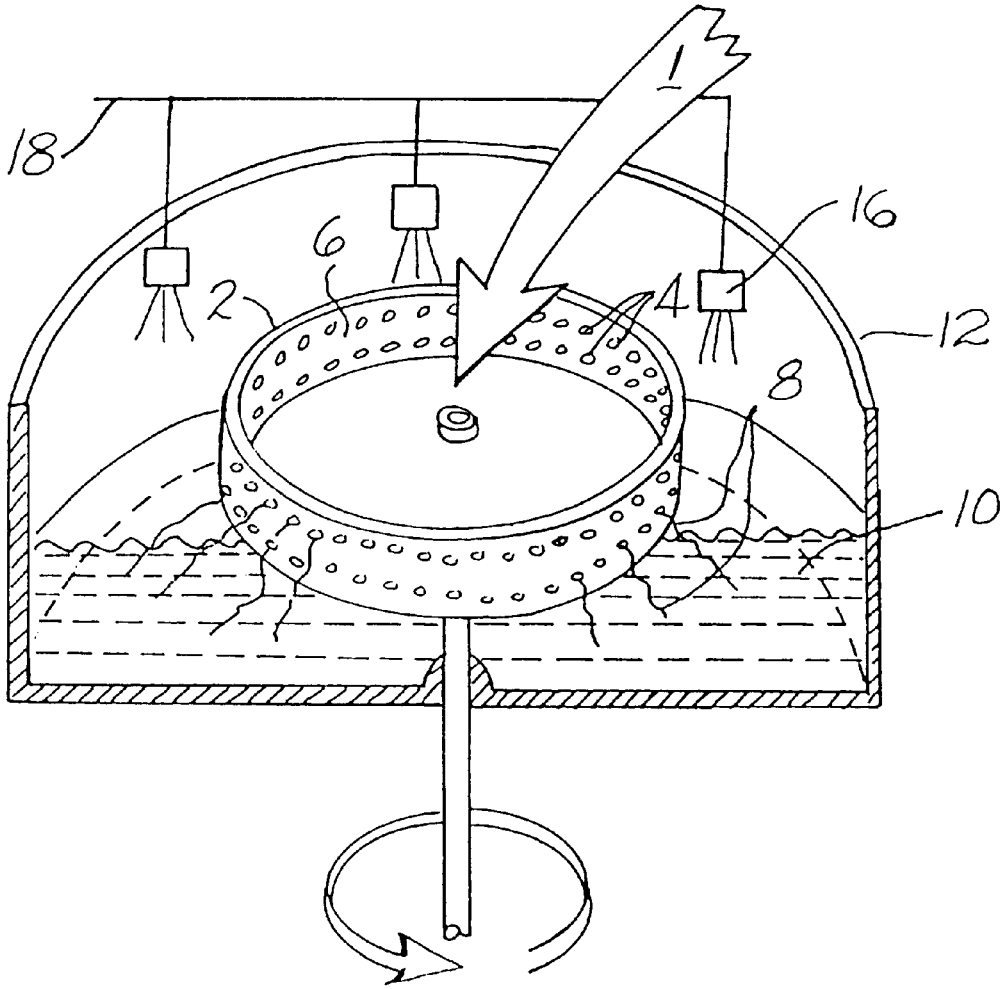
FIG. 2 is a partially cut away perspective representation of typical centrifugal spinning equipment used with the invention.

FIG. 2 is illustrative of a centrifugal spinning process. The heated cellulose dope 1 is directed into a heated generally hollow cylinder or drum 2 with a closed base and a multiplicity of small apertures 4 in the sidewalls, 6. As the cylinder rotates, dope is forced out horizontally through the apertures as thin strands 8. As these strands meet resistance from the surrounding air they are drawn or stretched by a large factor. The amount of stretch will depend on readily controllable factors such as cylinder rotational speed, orifice size, and dope viscosity. The dope strands either fall by gravity or are gently forced downward by an air flow into a non-solvent 10 held in a basin 12 where they are coagulated into individual oriented fibers having lengths from about 1 to 25 cm. Alternatively, the dope strands 8 can be either partially or completely regenerated by a water spray from a ring of spray nozzles 16 fed by a source of regenerating solution 18. Also, as will be described later, they can be formed into a nonwoven fabric prior to or during regeneration. Water is the preferred coagulating non-solvent although ethanol or water-ethanol mixtures are also useful. From this point the fibers are collected and may be washed to remove any residual NMMO, bleached as might be necessary, and dried. Example 2 that will follow gives specific details of laboratory centrifugally spun fiber preparation.

Figure 3:
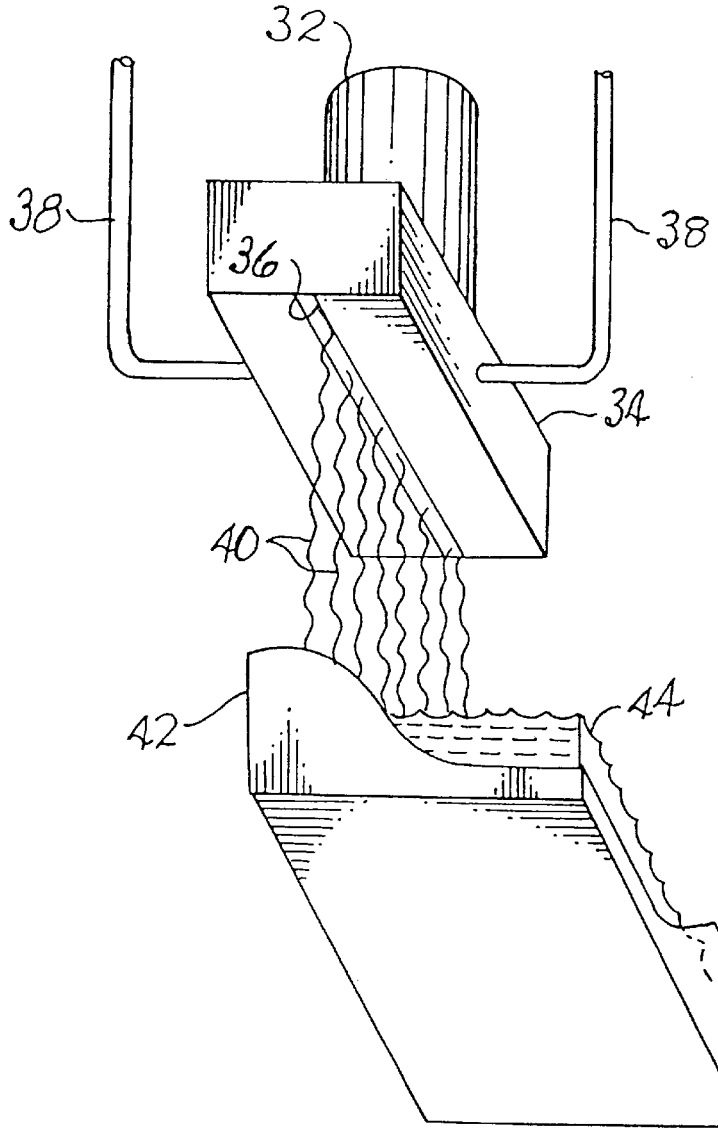
FIG. 3 is a partially cut away perspective representation of melt blowing equipment adapted for use with the present invention.
Figure 4:
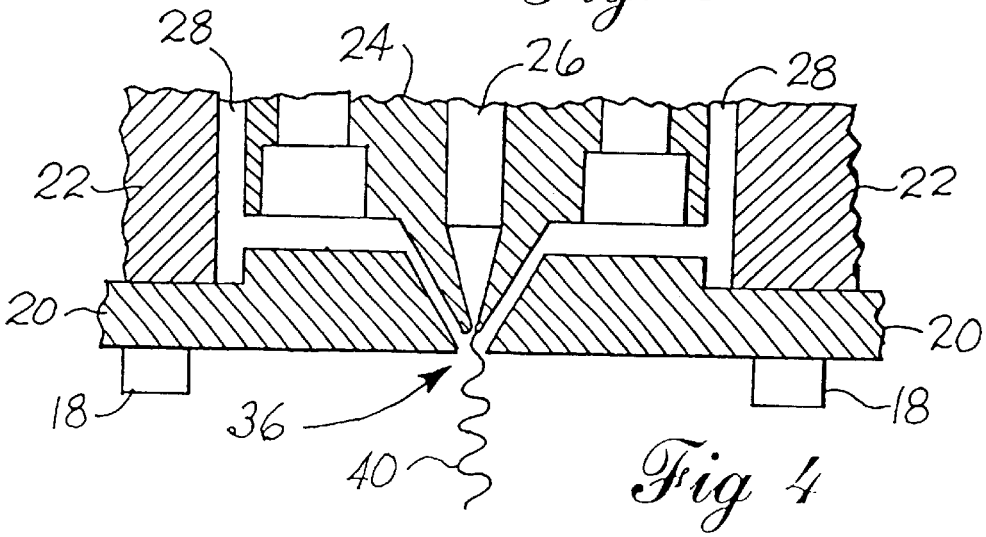
FIG. 4 is a cross sectional view of a typical extrusion head that might be used with the above melt blowing apparatus.

FIGS. 3 and 4 show details of a typical melt blowing process. As seen in FIG. 3, a supply of dope, not shown, is directed to an extruder 32 which forces the cellulose solution to an orifice head 34 having a multiplicity of orifices 36. Air or another gas is supplied through lines 38 and surrounds and transports extruded solution strands 40. A bath or tank 42 contains a regenerating solution 44 in which the strands are regenerated from solution in the solvent to cellulose fibers. Alternatively, the latent fibers can be showered with a water spray to regenerate or partially regenerate them. The amount of draw or stretch will depend on readily controllable factors such as orifice size, dope viscosity, cellulose concentration in the dope, and air speed and nozzle configuration.

FIG. 4 shows a typical extrusion orifice. The orifice plate 20 is bored with a multiplicity of orifices 36. It is held to the body of the extrusion head 22 by a series of cap screws 18. An internal member 24 forms the extrusion ports 26 for the cellulose solution. It is embraced by air passages 28 that surround the extruded solution filaments 40 causing them to be drawn and to assist in their transport to the regenerating medium. Example 3 that follows will give specific details of laboratory scale fiber preparation by melt blowing.

Figure 5:
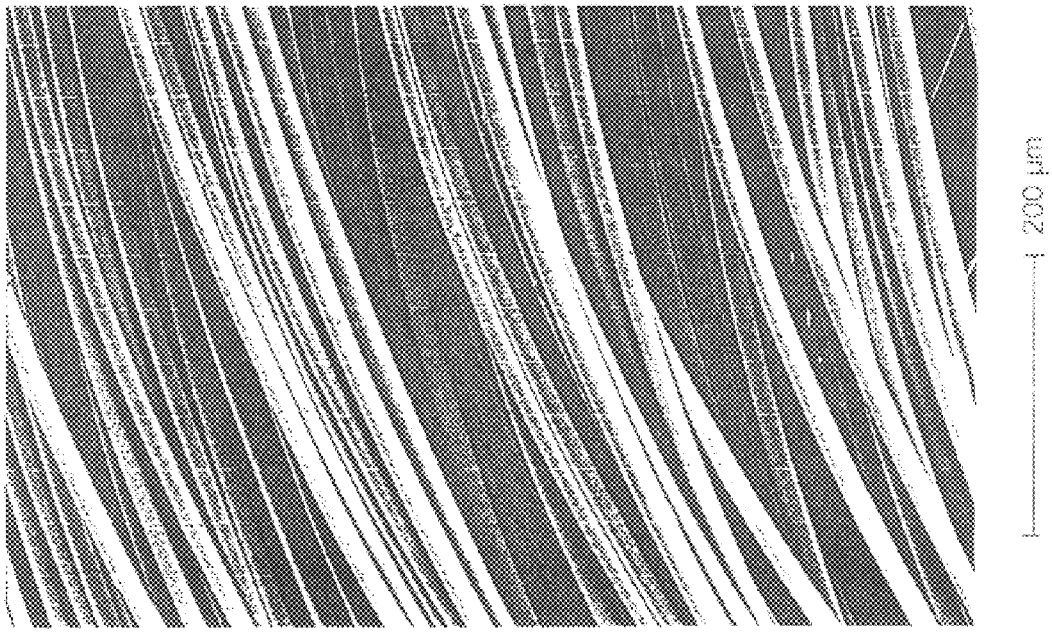
FIGS. 5 and 6 are scanning electron micrographs of a commercially available lyocell fiber at 100× and 10,000× magnification respectively.
Figure 6:
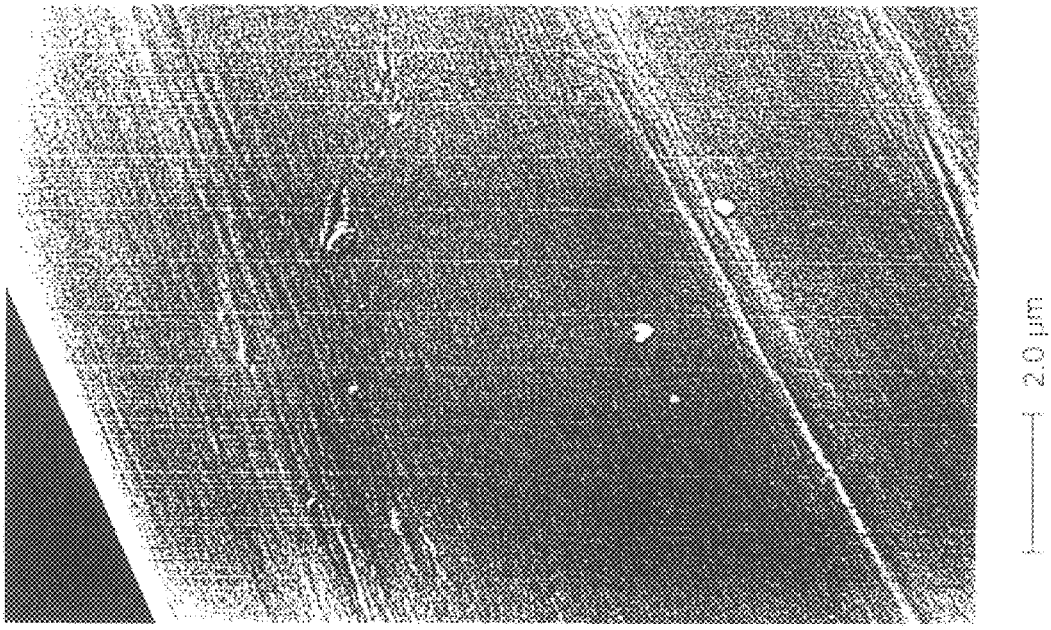

The scanning electron micrographs shown in FIGS. 5–6 are of lyocell fibers made by the conventional continuously drawn process. It is noteworthy that these are of quite uniform diameter and are essentially straight. The surface seen at 10,000× magnification in FIG. 6 is remarkably smooth.

FIGS. 7–10 are of fibers made by a centrifugal spinning process of the present invention. The fibers seen in FIG. 7 have a range of diameters and tend to be somewhat curly giving them a natural crimp. This natural crimp is quite unlike the regular sinuous configuration obtained in a stuffer box. Both amplitude and period are irregular and are at least several fiber diameters in height and length. Most of the fibers are somewhat flattened and some show a significant amount of twist. Fiber diameter varies between extremes of about 1.5 $\mu$m and 20 $\mu$m (<0.1–3.1 denier), with most of the fibers closely grouped around a 12 $\mu$m diameter average (c. 1 denier).

Figure 7:
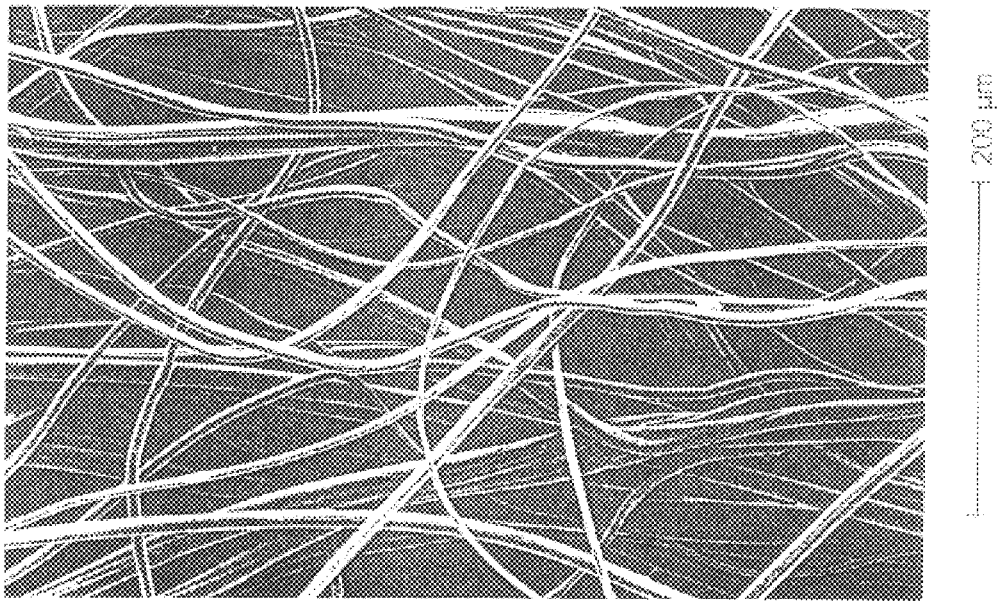
FIGS. 7 and 8 are scanning electron micrographs of a lyocell fiber produced by centrifugal spinning at 200× and 10,000× magnification respectively.
Figure 8:
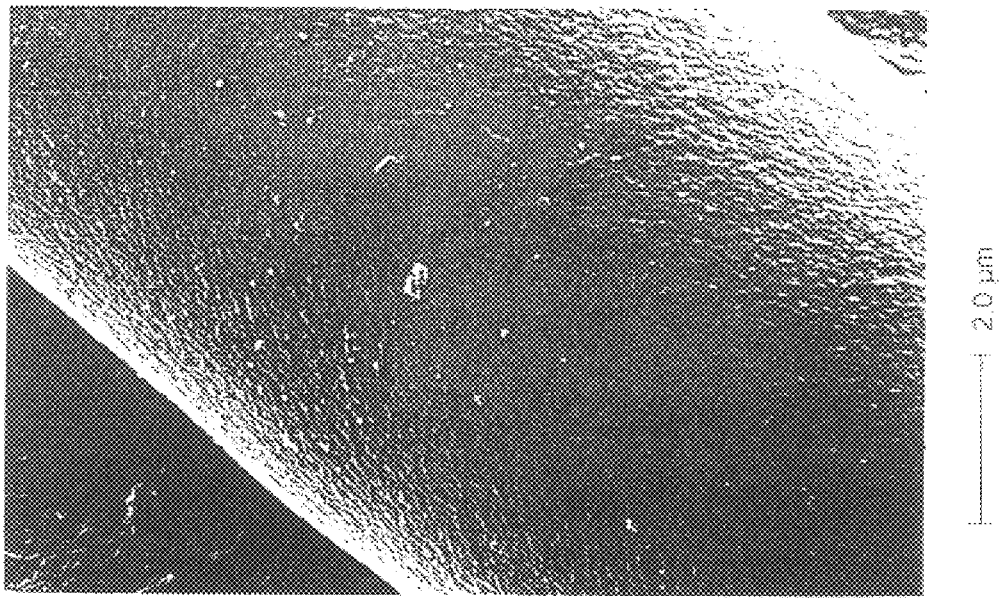

FIG. 8 shows the fibers of FIG. 7 at 10,000× magnification. The surface is uniformly pebbly in appearance, quite unlike the commercially available fibers. This results in lower gloss and improved spinning characteristics.

Figure 9:
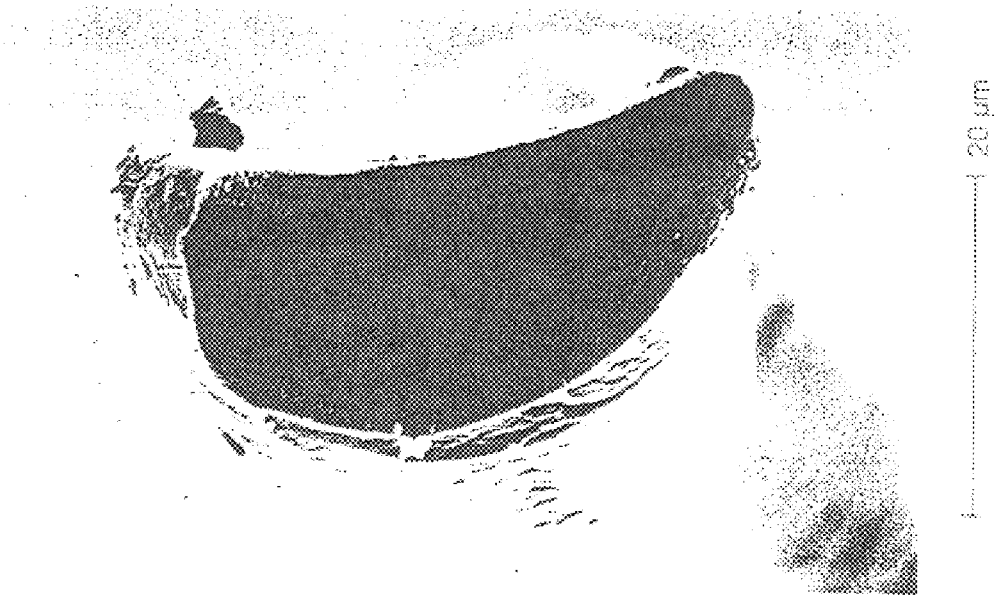
FIGS. 9 and 10 are scanning electron micrographs at 2,000× showing cross sections along a single centrifugally spun fiber.
Figure 10:
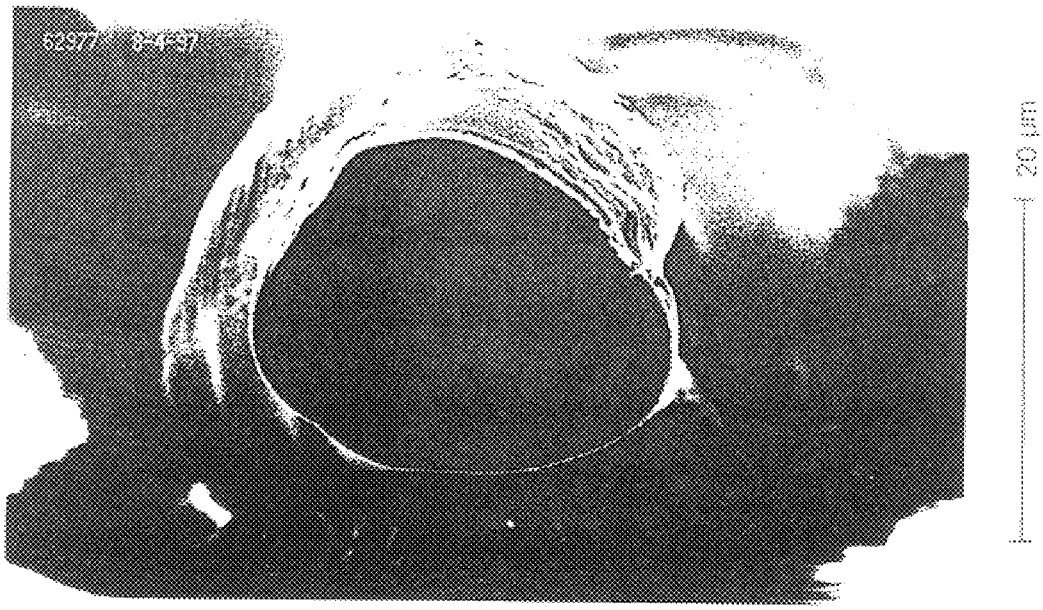

FIGS. 9 and 10 are scanning micrographs of fiber cross sections taken about 5 mm apart on a single centrifugally spun fiber. The variation in cross section and diameter along the fiber is dramatically shown. This variation is characteristic of both the centrifugally spun and melt blown fiber.

Figure 11:
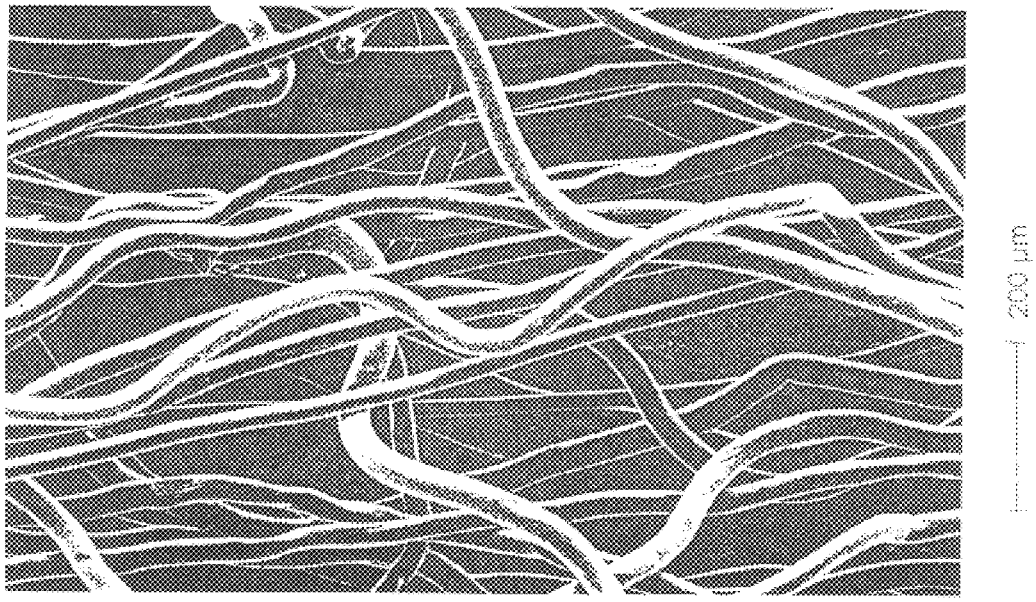
FIGS. 11 and 12 are scanning electron micrographs of a melt blown lyocell fiber at 100× and 10,000× magnification respectively.
Figure 12:
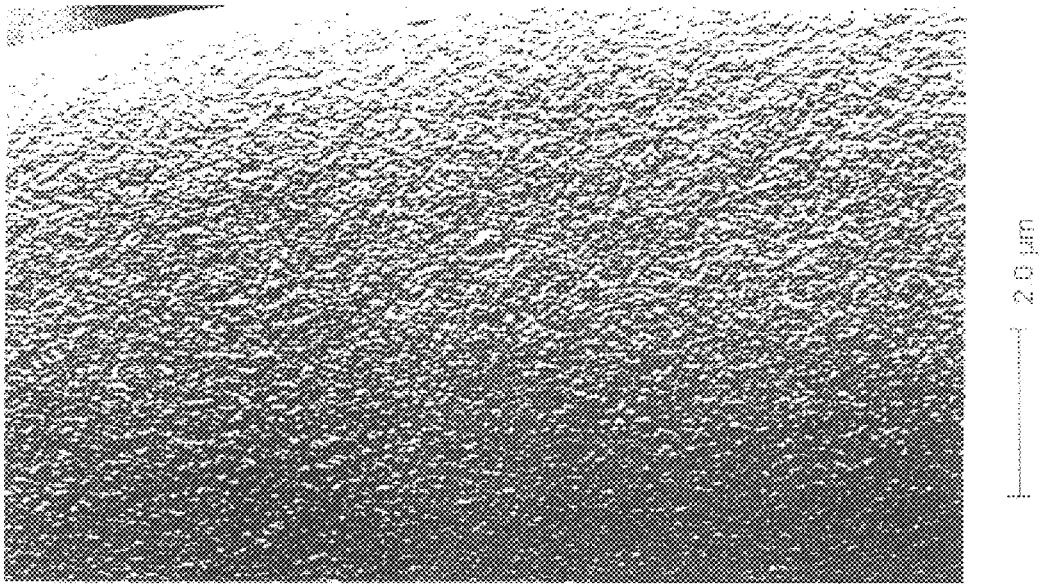

FIGS. 11 and 12 are low and high magnification scanning micrographs of melt blown fiber. Fiber diameter, while still variable, is less so than the centrifugally spun fiber. However, crimp of these samples is significantly greater. The micrograph at 10,000× of FIG. 12 shows a pebbly surface remarkably like that of the centrifugally spun fiber.

The overall morphology of fibers from both processes is highly advantageous for forming fine tight yarns since many of the features resemble those of natural fibers. This is believed to be unique for the lyocell fibers of the present invention.

Figure 13:
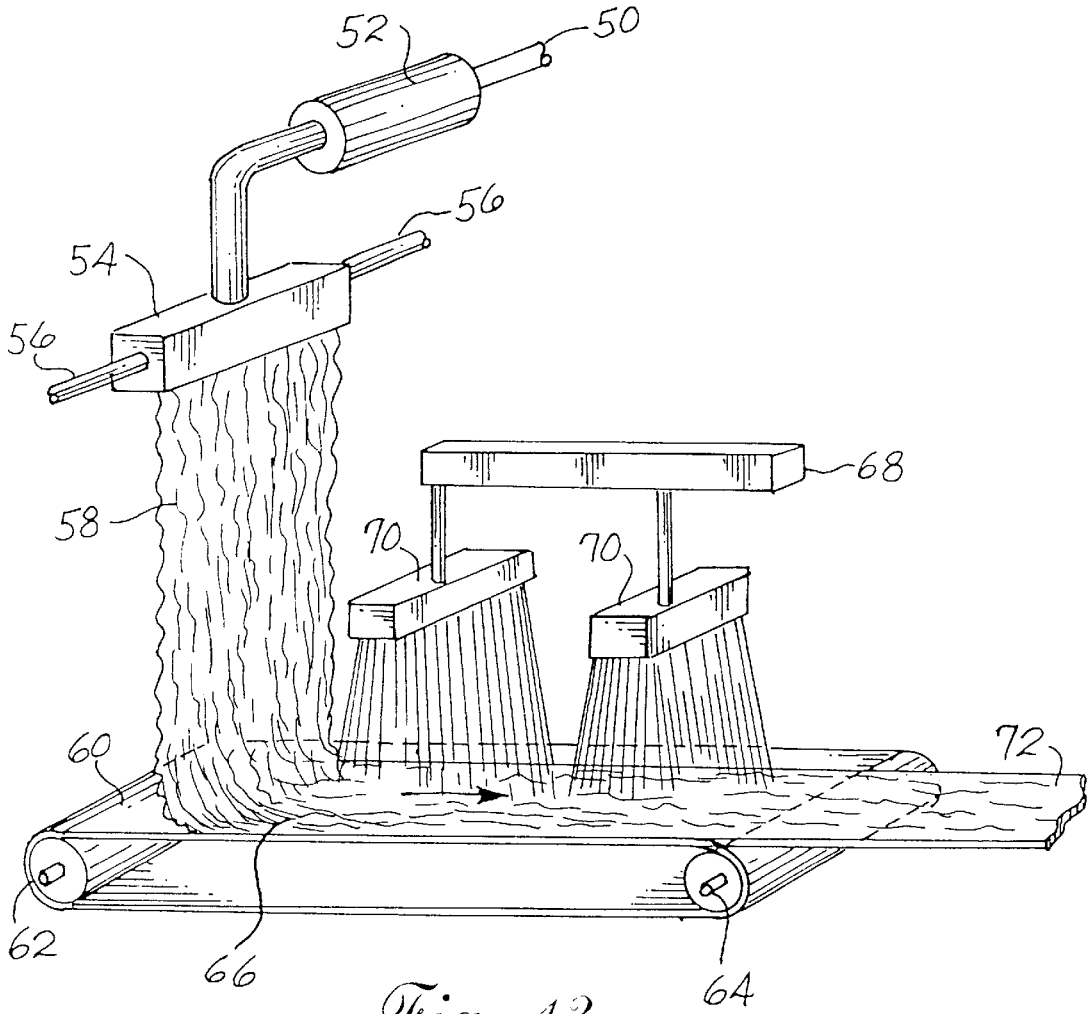
FIG. 13 is a drawing illustrating production of a self bonded nonwoven lyocell fabric using a melt blowing process.

FIG. 13 shows one method for making a self bonded lyocell nonwoven material using a modified melt blowing process. A cellulose dope 50 is fed to extruder 52 and from there to the extrusion head 54. An air supply 56 acts at the extrusion orifices to draw the dope strands 58 as they descend from the extrusion head. Process parameters are preferably chosen so that the resulting fibers will be continuous rather than random shorter lengths. The fibers fall onto an endless moving foraminous belt 60 supported and driven by rollers 62, 64. Here they form a latent nonwoven fabric mat 66. A top roller, not shown, may be used to press the fibers into tight contact and ensure bonding at the crossover points. As mat 66 proceeds along its path while still supported on belt 60, a spray of regenerating solution 68 is directed downward by sprayers 70. The regenerated product 72 is then removed from the end of the belt where it may be further processed; e.g., by further washing, bleaching, and drying.

Figure 14:
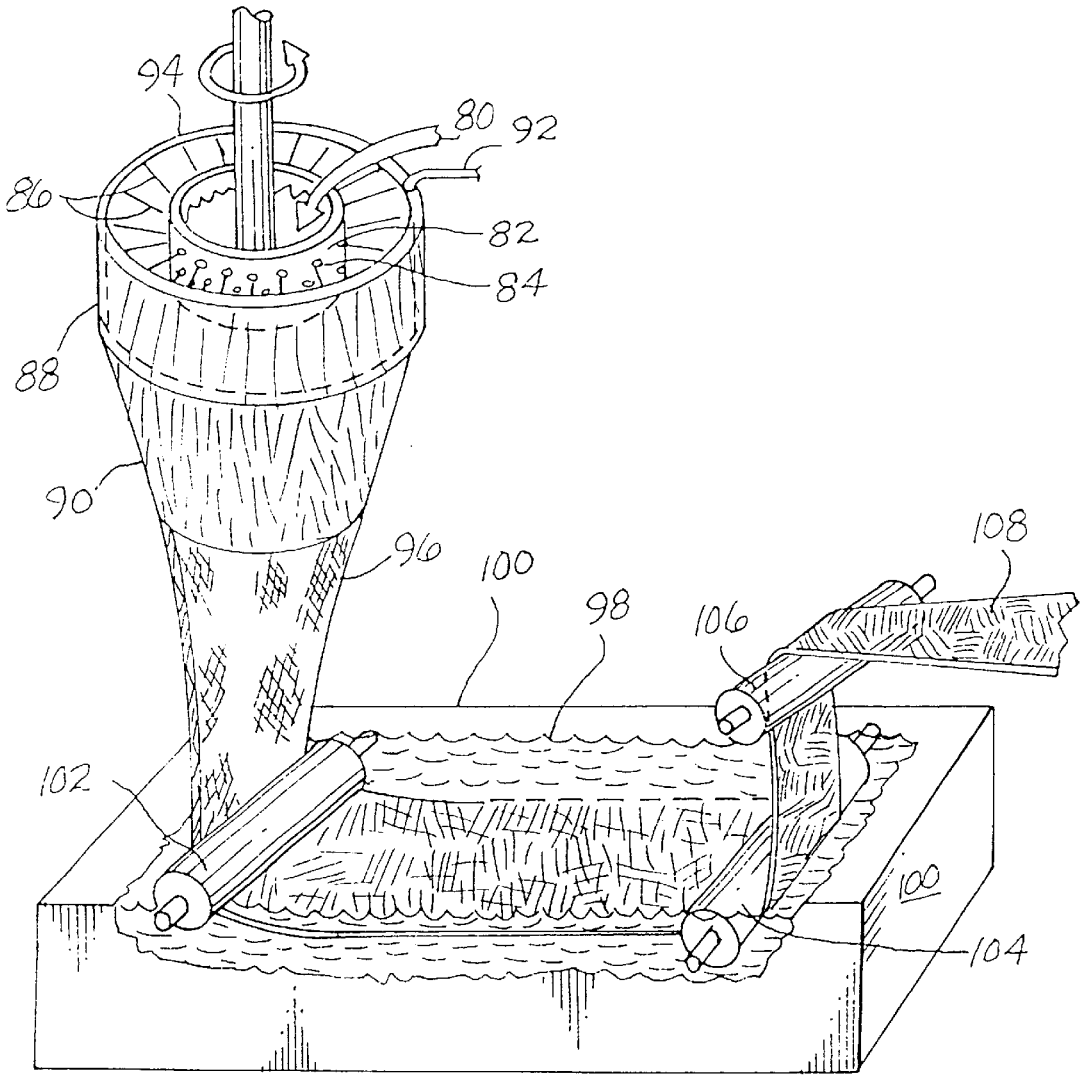
FIG. 14 is a similar drawing illustrating production of a self bonded nonwoven lyocell fabric using a centrifugal spinning process.

FIG. 14 is an alternative process for forming a self bonded nonwoven web using centrifugal spinning. A cellulose dope 80 is fed into a rapidly rotating drum 82 having a multiplicity of orifices 84 in the sidewalls. Latent fibers 86 are expelled through orifices 84 and drawn, or lengthened, by air resistance and the inertia imparted by the rotating drum. They impinge on the inner sidewalls of a receiver surface 88 concentrically located around the drum. The receiver may optionally have a frustoconical lower portion 90. A curtain or spray of regenerating solution 92 flows downward from ring 94 around the walls of receiver 88 to partially coagulate the cellulose mat impinged on the sidewalls of the receiver. Ring 94 may be located as shown or moved to a lower position if more time is needed for the latent fibers to self bond into a nonwoven web. The partially coagulated nonwoven web 96 is continuously mechanically pulled from the lower part 90 of the receiver into a coagulating bath 98 in container 100. As the web moves along its path it is collapsed from a cylindrical configuration into a planar two ply nonwoven structure. The web is held within the bath as it moves under rollers 102, 104. A takeout roller 106 removes the now fully coagulated two ply web 108 from the bath. Any or all of rollers 100, 102, or 104 may be driven. The web 108 is then continuously directed into a wash and/or bleaching operation, not shown, following which it is dried for storage. It may be split and opened into a single ply nonwoven or maintained as a two ply material as desired.

Fibrillation is defined as the splitting of the surface portion of a single fibers into microfibers or fibrils. The splitting occurs as a result of wet abrasion by attrition of fiber against fiber or by rubbing fibers against a hard surface. Depending on the conditions of abrasion, most or many will remain attached at one end to the mother fiber. The fibrils are so fine that they become almost transparent, giving a white, frosty appearance to a finished fabric. In cases of more extreme fibrillation, the micro-fibrils become entangled, giving the appearance and feel of pilling.

While there is no standard industry test to determine fibrillation resistance, the following procedure is typical of those used. 0.003 g of individualized fibers are weighed and placed with 10 mL of water in a capped 25 mL test tube (13×110 mm). Samples are placed on a shaker operating at low amplitude at a frequency of about 200 cycles per minute. The time duration of the test may vary from 4–80 hours. The samples shown in FIGS. 15–18 were shaken 4 hours.

Figure 15:
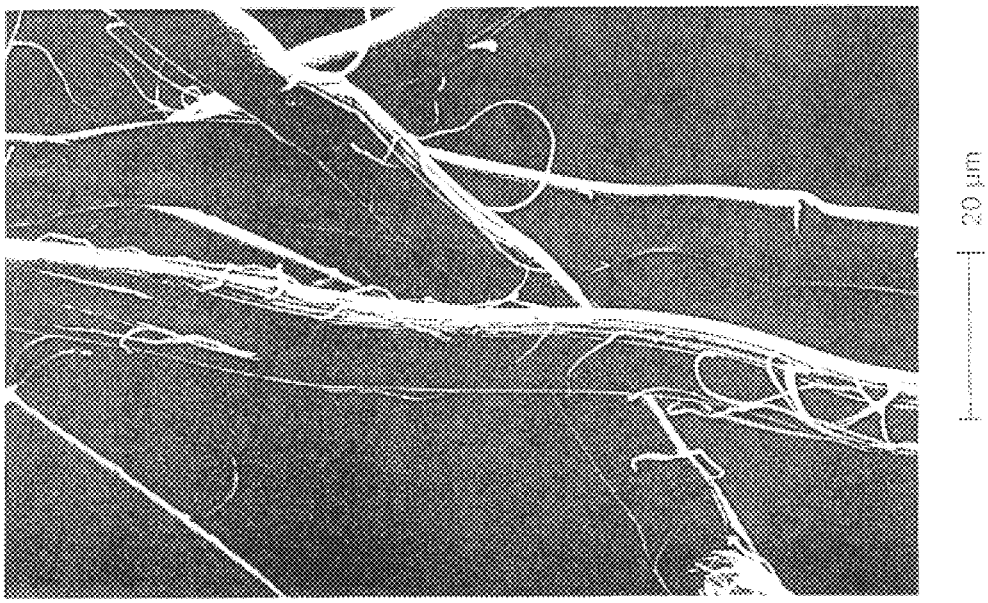
FIGS. 15 and 16 are scanning electron micrographs at 1000× of fibers from each of two commercial sources showing fibrillation caused by a wet abrasion test.
Figure 16:
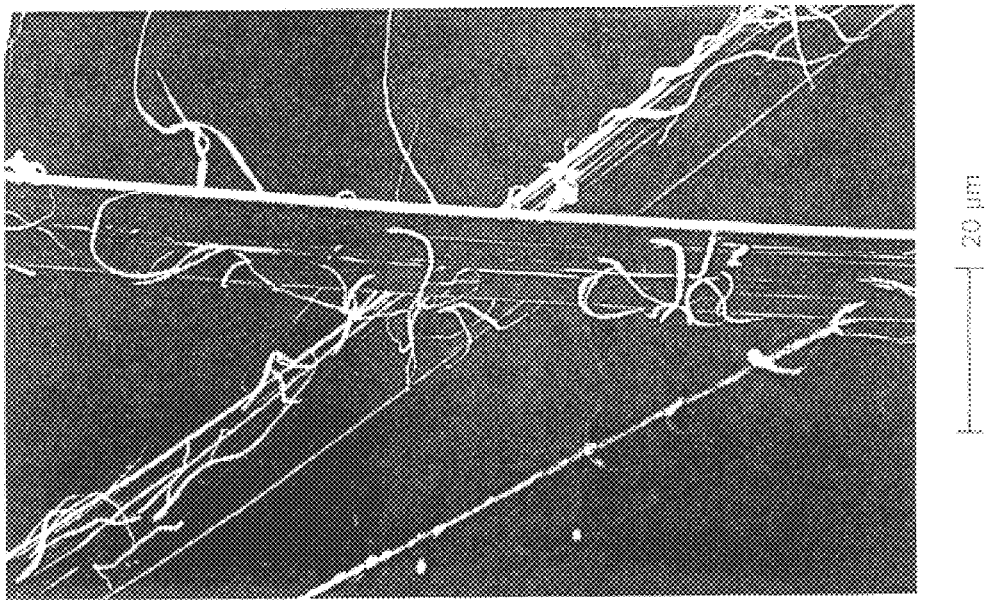
Figure 17:
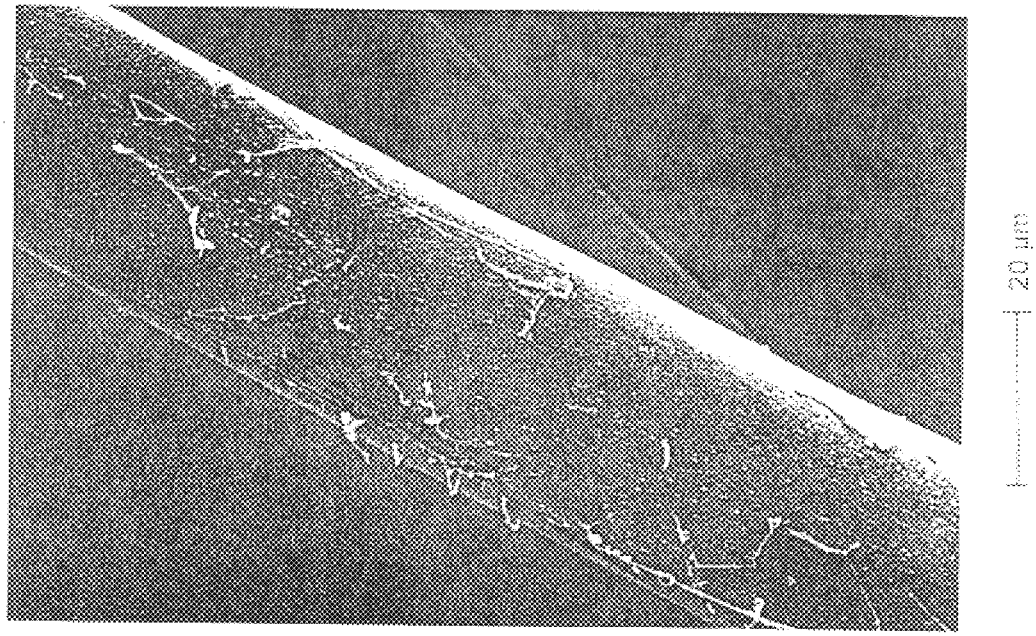
FIGS. 17 and 18 are scanning electron micrographs at 1000× of two fiber samples produced by the methods of the present invention similarly submitted to the wet abrasion test.
Figure 18:
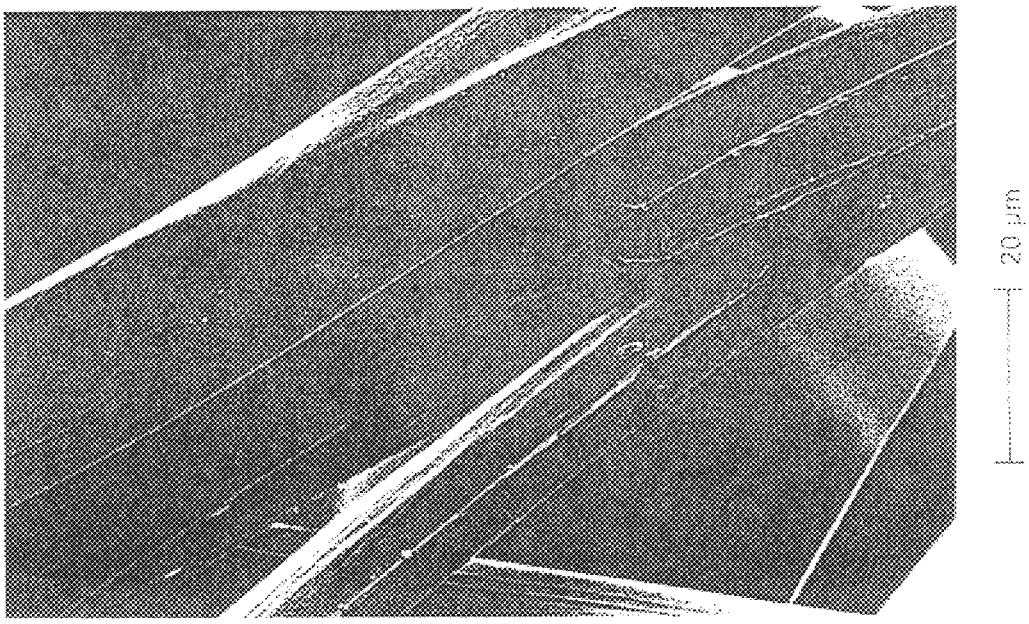

FIGS. 15 and 16 show the considerable fibrillation caused in fibers from commercially available yarns obtained from two different suppliers and tested as above. Compare these with FIGS. 17 and 18 which are two samples of "melt blown" fibers of the present invention. Fibrillation is very minor. The reasons for this are not fully understood. However, it is believed that the fibers of the present invention have somewhat lower crystallinity and orientation than those produced by existing commercial processes. In addition to the reduced tendency to fibrillate, the fibers of the invention also have been found to have greater and more uniform dye receptivity. The tendency to acquire a "frosted" appearance after use, caused by fibrillation, is almost entirely absent.

EXAMPLE 1

Cellulose Dope Preparation

The cellulose pulp used in this and the following examples was a standard bleached kraft southern softwood market pulp, Grade NB 416, available from Weyerhaeuser Company, New Bern, N.C. It has an alpha cellulose content of about 88–89% and a D.P. of about 1200. Prior to use, the sheeted wood pulp was run through a fluffer to break it down into essentially individual fibers and small fiber clumps. Into a 250 mL three necked glass flask was charged 5.3 g of fluffed cellulose, 66.2 g of 97% NMMO, 24.5 g of 50% NMMO, and 0.05 g propyl gallate. The flask was immersed in an oil bath at 120° C., a stirrer inserted, and stirring continued for about 0.5 hr. A readily flowable dope resulted that was directly suitable for spinning.

EXAMPLE 2

Fiber Preparation by Centrifugal Spinning

The spinning device used was a modified "cotton candy" type, similar to that shown in U.S. Pat. No. 5,447,423 to Fuisz et al. The rotor, preheated to 120° C. was 89 mm in diameter and revolved at 2800 rpm. The number of orifices could be varied between 1 and 84 by blocking off orifices. Eight orifices 700 μm in diameter were used for the following trial. Cellulose dope, also at 120° C., was poured onto the center of the spinning rotor. The thin strands of dope that emerged were allowed to fall by gravity into room temperature water contained in the basin surrounding the rotor. Here they were regenerated. While occasional fibers would bond to each other most remained individualized and were several centimeters in length.

In addition to the process just described, very similar microdenier fibers were also successfully made from bleached and unbleached kraft pulps, sulfite pulp, microcrystalline cellulose, and blends of cellulose with up to 30% corn starch or poly(acrylic acid).

Diameter (or denier) of the fibers could be reliably controlled by several means. Higher dope viscosities tended to form heavier fibers. Dope viscosity could, in turn, be controlled by means including cellulose solids content or degree of polymerization of the cellulose. Smaller spinning orifice size or higher drum rotational speed produces smaller diameter fibers. Fibers having diameters from about 5–20 μm (0.2–3.1 denier) were reproducibly made. Heavier fibers in the 20–50 μm diameter range (3.1–19.5 denier) could also be easily formed. Fiber length varies between about 0.5–25 cm and depended considerably on the geometry and operational parameters of the system.

EXAMPLE 3

Fiber Preparation by Melt Blowing

The dope as prepared in Example 1 was maintained at 120° C. and fed to an apparatus originally developed for forming melt blown synthetic polymers. Overall orifice length was about 50 mm with a diameter of 635 μm which tapered to 400 μm at the discharge end. After a transit distance in air of about 20 cm in the turbulent air blast the fibers dropped into a water bath where they were regenerated. Regenerated fiber length varied. Some short fibers were formed but most were several centimeters to tens of centimeters in length. Variation of extrusion parameters enabled continuous fibers to be formed. Quite surprisingly, the cross section of many of the fibers was not uniform along the fiber length. This feature is expected to be especially advantageous in spinning tight yams using the microdenier material of the invention since the fibers more closely resemble natural fibers in overall morphology.

In a variation of the above process, the fibers were allowed to impinge on a traveling stainless steel mesh belt before they were directed into the regeneration bath. A well bonded nonwoven mat was formed.

It will be understood that the lyocell nonwoven fabrics need not be self bonded. They may be only partially self bonded or not self bonded at all. In these cases they may be bonded by any of the well known methods including but not limited to hydroentangling, the use of adhesive binders such as starch or various polymer emulsions or some combination of these methods.

EXAMPLE

Use of Microcrystalline Cellulose Furnish to Prepare Melt Blown Lyocell

The process of Example 1 was repeated using a microcrystalline finish rather than wood pulp in order to increase solids content of the dope. The product used was Avicel® Type pH-101 microcrystalline cellulose available from FMC Corp., Newark, Del. Dopes were made using 15 g and 28.5 g of the microcrystalline cellulose (dry weight) with 66.2 g of 97% NMMO, 24.5 g of 50% NMMO and 0.05 g propyl gallate. The procedure was otherwise as described in Example 1. The resulting dopes contained respectively about 14% and 24% cellulose. These were meltblown as described in Example 3. The resulting fiber was morphologically essentially identical to that of Examples 2 and 3.

It will be understood that fiber denier is dependent on many controllable factors. Among these are solution solids content, solution pressure and temperature at the extruder head, orifice diameter, air pressure, and other variables well known to those skilled in meltblowing and centrifugal spinning technology. Lyocell fibers having an average 0.5 denier or even lower may be consistently produced by either the melt blowing or centrifugal spinning processes. A 0.5 denier fiber corresponds to an average diameter (estimated on the basis of equivalent circular cross sectional area) of about 7–8 μm.

The fibers of the present invention were studied by x-ray analysis to determine degree of crystallinity and crystallite type. Comparisons were also made with some other cellulosic fibers as shown in the following table. Data for the microdenier fibers are taken from the centrifugally spun material of Example 2.

TABLE 1

Crystalline Properties of Different Cellulose Fibers

| Fibers | Microdenier Cellulose of Present Invention | Generic Lyocell | Tencel ® | Cotton |
|---|---|---|---|---|
| Crystallinity Index | 67% | 65% | 70% | 85% |
| Crystallite | Cellulose II | Cellulose II | Cellulose II | Cellulose I |

Some difficulty was encountered in measuring tensile strength of the individual fibers so the numbers given in the following table for tenacity are estimates. Again, the microdenier fibers of the present invention are compared with a number of other fibers.

TABLE 2

| Fiber Physical Property Measurements | | | | | | |
|---|---|---|---|---|---|---|
| Fibers | Cotton | So. Pine | Rayon[1] | Silk | Centrifugally Spun Lyocell | Tencel |
| Typical Length, cm | 4 | 0.5 | 40 | $>10^4$ | 5–25 | Variable |
| Typical Diam., $\mu$m | 20 | 40 | 16 | 10 | 5 | 12 |
| Tenacity, g/d | 2.5–3.0 | — | 0.7–3.2 | 2.8–5.2 | 2.1 | 4.5–5.0 |

[1]Viscose process

The centrifugally spun lyocell with an average diameter of about 5 $\mu$m corresponds to fibers of about 0.25 denier.

The pebbled surface of the fibers of the present invention result in a desirable lower gloss without the need for any internal delustering agents. While gloss or luster is a difficult property to measure the following test will be exemplary of the differences between a fiber sample made by the method of Example 2 and a commercial lyocell fiber. Small wet formed handsheets were made from the respective fibers and light reflectance was determined. Reflectance of the Example 2 material was 5.4% while that of the commercial fiber was 16.9%.

While the preferred embodiment of the invention has been illustrated and described, it will be appreciated that various changes can be made therein without departing from the spirit and scope of the invention.

What is claimed is:

1. A method of forming a lyocell nonwoven fabric which comprises:

depositing a multiplicity of strands of a cellulose solution from apertures onto a receiving surface to form a fiber mat;

contacting the formed mat with a regenerating solution; and removing the regenerated mat from the receiving surface.

2. The method of claim 1 which further comprises spraying the regenerating solution on the mat.

3. The method of claim 1 which further comprises moving the mat containing receiving surface into a bath of regenerating solution.

4. The method of claim 1 which further comprises spraying regenerating solution on the strands to at least partially regenerate them prior to deposition on the receiving surface.

5. The method of claim 1, including permitting the latent fiber strands to become self-bonded prior to regeneration.

6. The method according to claim 1, wherein the receiving surface is a moving receiving surface.

7. A method for forming a lyocell nonwoven fabric, comprising stretching cellulose solution into filaments using a gas.

8. The method according to claim 7, wherein the gas is air.

9. The method according to claim 7, further comprising:

depositing a multiplicity of the filaments on a moving receiving surface to form a fiber mat;

contacting the mat with a regenerating solution; and removing the regenerated mat from the receiving surface.

10. The method according to claim 6, wherein the moving receiving surface is a foraminous belt.

* * * * *